US008465329B2

(12) United States Patent
Fields et al.

(10) Patent No.: US 8,465,329 B2
(45) Date of Patent: Jun. 18, 2013

(54) AUDIO CONNECTOR HAVING ADDITIONAL DETECTION SWITCH

(75) Inventors: Stewart Shannon Fields, Bend, OR (US); Joshua Funamura, San Jose, CA (US)

(73) Assignee: Apple Inc., Cupertino, CA (US)

( * ) Notice: Subject to any disclaimer, the term of this patent is extended or adjusted under 35 U.S.C. 154(b) by 194 days.

(21) Appl. No.: 12/895,711

(22) Filed: Sep. 30, 2010

(65) Prior Publication Data

US 2011/0237131 A1 Sep. 29, 2011

Related U.S. Application Data

(60) Provisional application No. 61/275,692, filed on Sep. 30, 2009.

(51) Int. Cl.
*H01R 24/04* (2006.01)

(52) U.S. Cl.
USPC ..... 439/668; 439/188

(58) Field of Classification Search
USPC ..... 439/668, 188, 669
See application file for complete search history.

(56) References Cited

U.S. PATENT DOCUMENTS

| | | | | |
|---|---|---|---|---|
| 6,056,602 | A * | 5/2000 | Wu | 439/668 |
| 6,109,797 | A * | 8/2000 | Nagura et al. | 385/88 |
| 6,790,095 | B2 * | 9/2004 | Liu | 439/668 |
| 7,108,529 | B1 * | 9/2006 | Huang | 439/188 |
| 7,112,099 | B2 * | 9/2006 | Ma | 439/668 |
| 2006/0166561 | A1 * | 7/2006 | Ma | 439/668 |

* cited by examiner

*Primary Examiner* — Gary F. Paumen
(74) *Attorney, Agent, or Firm* — Kilpatrick Townsend & Stockton LLP

(57) ABSTRACT

Circuits, methods, and apparatus for improved audio connectors. One example provides an audio connector, that, for purposes of activating circuitry to receive signals from a microphone, does not detect the presence of an audio jack until the audio jack is inserted far enough into the audio connector that a microphone contact on the audio jack comes into contact with a microphone signal pin on the audio connector. To prevent the redirection of audio signals away from an audio jack when the audio jack is partially extracted from the audio connector, such partial extractions are not detected by audio signal pins.

20 Claims, 6 Drawing Sheets

1. As audio jack is inserted, retention clips (not shown) deflect to hold audio jack.
2. Audio jack not engaged with switch contacts.
3. Mic switch & HP switch not opened.

4. As audio jack continues to be inserted, HP switch contact is deflected, opening HP switch. Right and left signal pins are enabled. Mic signal pin remains disabled.

5. When audio jack is completely inserted, mic switch and HP switch both open. Mic switch engagement triggers addtional usage of mic signal pin.

6. As audio jack is partialy extracted, mic switch closes while HP switch remains open. Right and left signal pins are enabled. Mic signal pin disbaled.

7. Audio jack continues to be extracted, both mic switch & HP switch close. All signal pins disabled.

AUDIO CONNECTOR HAVING ADDITIONAL DETECTION SWITCH

This application claims the benefit of U.S. provisional application No. 61/275,692, filed Sep. 30, 2009, which is incorporated by reference.

BACKGROUND

Audio connectors have become ubiquitous the last several years, finding their way into computers, media players, and other electronic devices. These connectors accept audio jacks that may come in at least two types, 3-pole and 4-pole jacks. A 3-pole jack may have two contacts for audio signals, left and right, and an additional contact for ground. A 4-pole jack may add a contact for a microphone.

Audio signals generated by circuitry associated with an audio connector may be provided to the audio connector and passed to an audio jack. The audio signals may then be passed to speakers, headphones, or other devices via the audio jack. The circuitry associated with an audio connector may be encompassed in a device enclosure along with the audio connector.

Audio signals generated by a microphone or other audio equipment external to the device enclosure may be provided to a microphone contact on an audio jack. These signals may then be passed to the audio connector and then to circuitry inside the device enclosure associated with the audio connector.

As an audio jack is inserted into an audio connector, the microphone contact in the audio connector may come into contact with other contacts on the audio jack before the microphone contact on the audio jack reaches the microphone contact on the audio connector. This may cause a clicking noise that appears to be generated by the microphone and is passed to circuitry associated with the audio connector. This noise may be misinterpreted by this circuitry in undesirable ways. For example, a headset may interpret the clicks as an incoming phone call. Thus, it may be desirable to not activate such circuitry until the audio jack is completely (or nearly completely) inserted into the audio connector.

Also, if an audio jack is partially pulled out of an audio connector, the audio signals may be redirected away from the audio jack. For example, a user listening to music on her headphones may find the sound redirected to speakers when she accidentally partially pulls the audio jack out of the audio connector. Thus, it is desirable to prevent this redirection when an audio jack is partially removed from an audio connector.

SUMMARY

Accordingly, embodiments of the present invention provide circuits, methods, and apparatus for improved audio connectors. An illustrative embodiment of the present invention may provide an audio connector, that, for purposes of activating circuitry to receive signals from a microphone, does not detect the presence of an audio jack until the audio jack is inserted far enough into the audio connector that a microphone contact on the audio jack comes into contact with a microphone contact on the audio connector. This may prevent undesirable clicking noises from confusing circuits that receive signals from an external microphone.

This illustrative embodiment of the present invention may also prevent a redirect of audio signals from the audio jack when the audio jack is partially extracted from the audio connector. With this, a user who is quietly listening to his headphones won't have his music issuing from speakers if he accidently pulls the audio jack partially from the audio connector.

A specific embodiment of the present invention may achieve these goals by employing multiple detection switches. One such detection switch may be a microphone detection switch that may be active when an audio jack is at least nearly completely inserted in the audio connector. Specifically, the detection switch may be active when an audio jack is inserted far enough into the audio connector such that a microphone contact on an audio jack comes into contact with a microphone contact on an audio connector. At this time, a left audio contact, a right audio contact, and a ground contact on the audio jack may come into contact with corresponding left audio, right audio, and ground contacts on the audio connector.

This specific embodiment may also include a headphone detection switch. This headphone detection switch may be placed closer to the opening of an audio connector than the microphone switch. This may allow the headphone detection switch to remain active when an audio jack is partially extracted from an audio connector.

Various embodiments of the present invention may include other switches, contacts, and circuits. For example, right audio, left audio, ground, and microphone contacts or signal pins may be included. Also, in other embodiments of the present invention, other types of contacts may be provided. One or more contacts may be provided to determine whether an audio jack is metallic, and is hence analog in nature, or plastic, and is hence compliant with digital signaling. Retention clips may be used to provide a desirable touch or feel to the user during insertion of an audio jack.

Audio connectors according to embodiments of the present invention may be employed in computers, laptops, netbooks, tablet computers, media players, portable media players, home theater systems, amplifiers, cell phones, and other devices.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
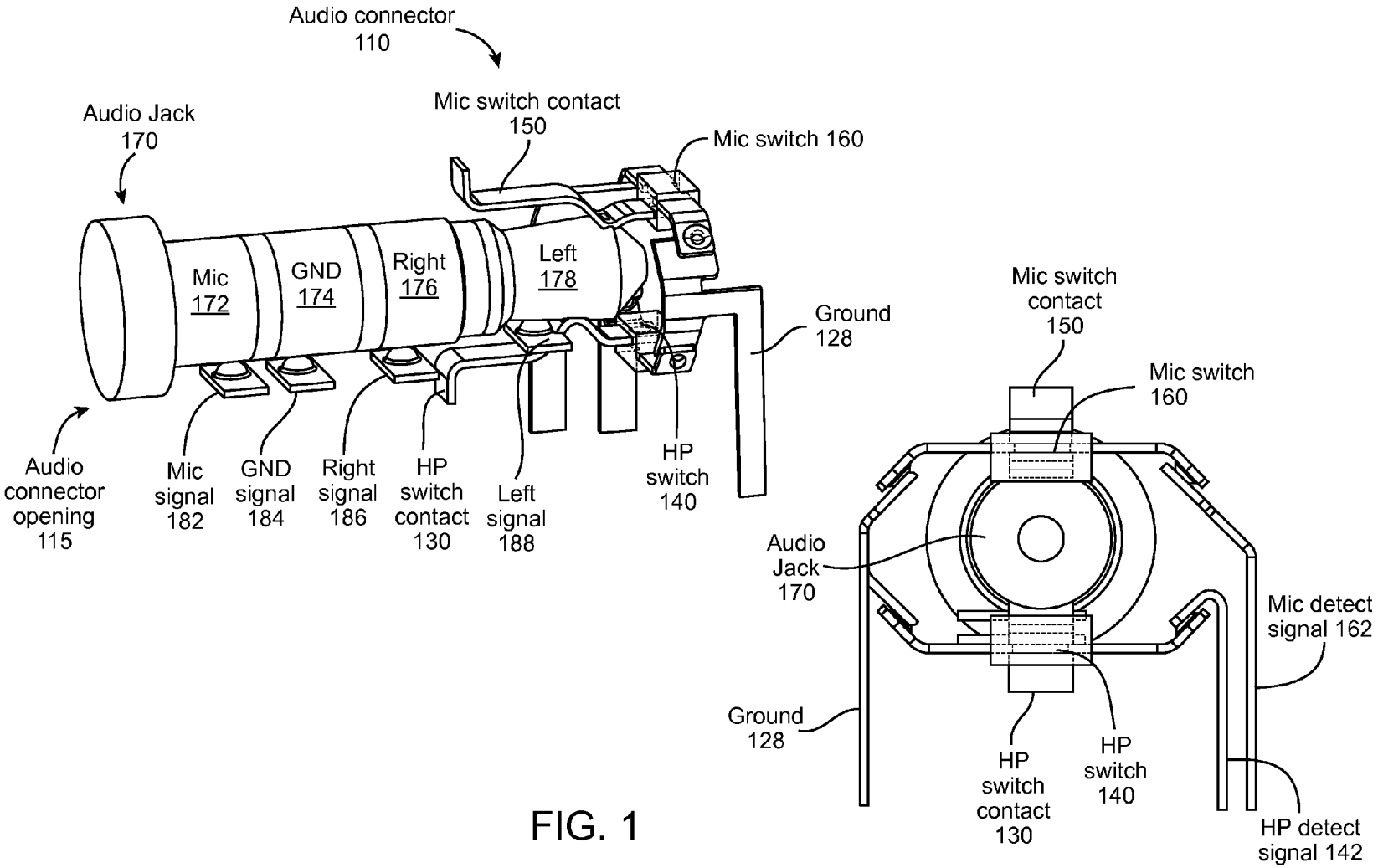
FIG. 1 illustrates front and side views of an audio connector according to an embodiment of the present invention along with an audio jack.

FIG. 1 illustrates a side view of an audio connector 110 according to an embodiment of the present invention. Audio connector 110 may be employed in computers, laptops, netbooks, tablet computers, media players, portable media players, home theater systems, amplifiers, cell phones, or other devices. Also shown is an audio jack 170 that may be inserted into audio connector 110. This figure, as with the other included figures, is shown for illustrative purposes only and does not limit either the possible embodiments of the present invention or the claims.

Audio connector 110 may include opening 115 for accepting audio jack 170. A back of audio connector 110 may be positioned at the far end of the audio connector away from opening 115. Audio connector 110 may include retention clips (not shown), headphone switch contact 130, headphone switch 140, microphone switch contact 150, and microphone switch 160. Headphone switch contact 130 and microphone switch contact 150 may be formed as fingers or other protrusions that are displaced as audio jack 170 is inserted into audio connector 110. Microphone 182, left 178, right 176, and ground 174 signal pins may also be included. These signal pins may be positioned such that they come into contact with corresponding microphone 172, left audio 176, right audio 178, and ground contacts 174 on audio jack 170 when audio jack 170 is fully inserted or engaged with audio connector 110. In various embodiments of the present invention, headphone switch contact 130 and microphone switch contact 150 may be incorporated with one of more of the left audio, right audio, or microphone contacts on audio connector 110. Additional circuitry, such as photo-diode detectors, may be included for digital audio jack compatibility.

Microphone switch contact 150 may be placed near the back of audio connector 110, such that microphone switch contact 150 does not detect the presence of audio jack 170 until audio jack 170 is nearly completely inserted into audio connector 110. In a specific embodiment of the present invention, microphone switch contact 150 may not detect the presence of audio jack 170 until microphone signal pin 182 in audio connector 110 is in contact with microphone contact 172 on audio jack 170. By having microphone switch 160 remain closed until this point is reached, a clicking noise, which might otherwise result as right 178, left 176, and ground 174 contacts on audio jack 170 slide past the microphone contact 182 on audio connector 110, may not occur.

When audio jack 170 is sufficiently inserted into audio connector 110, audio jack 170 may displace microphone switch contact 150 upwards. This action opens microphone switch 160. The opening of microphone switch 160 may be used to activate circuitry that receives signals from the microphone contact in audio connector 110.

In this example, headphone switch contact 130 may be placed between microphone switch contact 150 and audio connector opening 115. In this way, the presence of audio jack 170 remains detected by headphone switch contact 130 when audio jack 170 is partially removed from audio connector 110. By having headphone switch contact 130 so positioned, the redirection of the audio signals being provided to the left 188 and right 186 signal pins in audio connector 110 may not occur.

As with microphone switch contact 150, when audio jack 170 is sufficiently inserted into audio connector 110, audio jack 170 may displace headphone switch contact 130 downwards. This opens headphone switch 140. The opening of headphone switch 140 may be used to activate circuitry that provides signals to the left 178 and right 176 signal pins in audio connector 110.

Audio connector 110 may be enclosed in a housing that may be formed of plastic, ceramic, or other material or combination of materials. Headphone switch contact 130 and microphone switch contact 150 may be made of plastic, metal, or other material having a spring-like quality, such that they may be displaced when audio jack 170 is inserted into audio connector 110 and returned to their original position when audio jack 170 is removed. In this example, headphone switch 140 and microphone switch 160 are active-open mechanical switches, though in other embodiments they may be active-closed or other types of switches.

Audio jack 170 may be connected to headphones, speakers, amplifiers, or other devices. Audio jack 170 includes conductive contacts for microphone 172, ground 174, left audio 178, and right audio 176.

Figure 2:
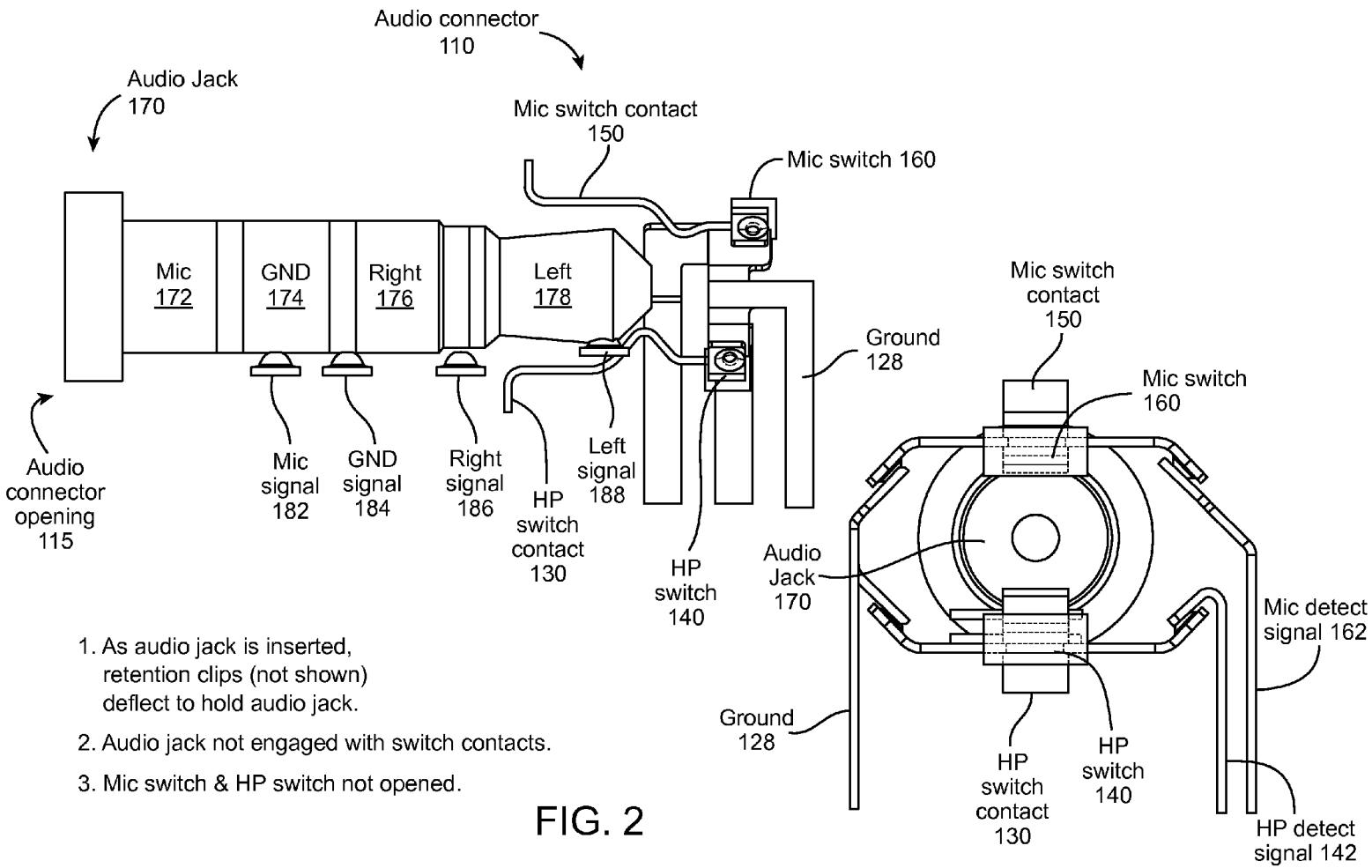
FIG. 2 illustrates the positions of an audio jack and an audio connector when the audio jack is initially being inserted into the audio connector according to an embodiment of the present invention.

FIG. 2 illustrates the positions of audio jack 170 and audio connector 110 when audio jack 170 is initially inserted into audio connector 110 according to an embodiment of the present invention. The leading portion of audio jack 170 may push against retention clips (not shown) as it is inserted into audio connector 110. This may provide a desired feel or touch to a user as audio jack 170 is inserted into audio connector 110. Various embodiments of the present invention may employ one or more than one retention clips. These retention clips may be aligned with each other, that is, they may be equidistant from opening 115 of audio connector 110. These retention clips may be offset from each other, or a combination of equidistant and offset retention clips may be used. In this configuration, the microphone switch 160 and headphone switch 140 are closed, and signal pins for microphone 182, right 186, and left 188 are disabled.

Figure 3:
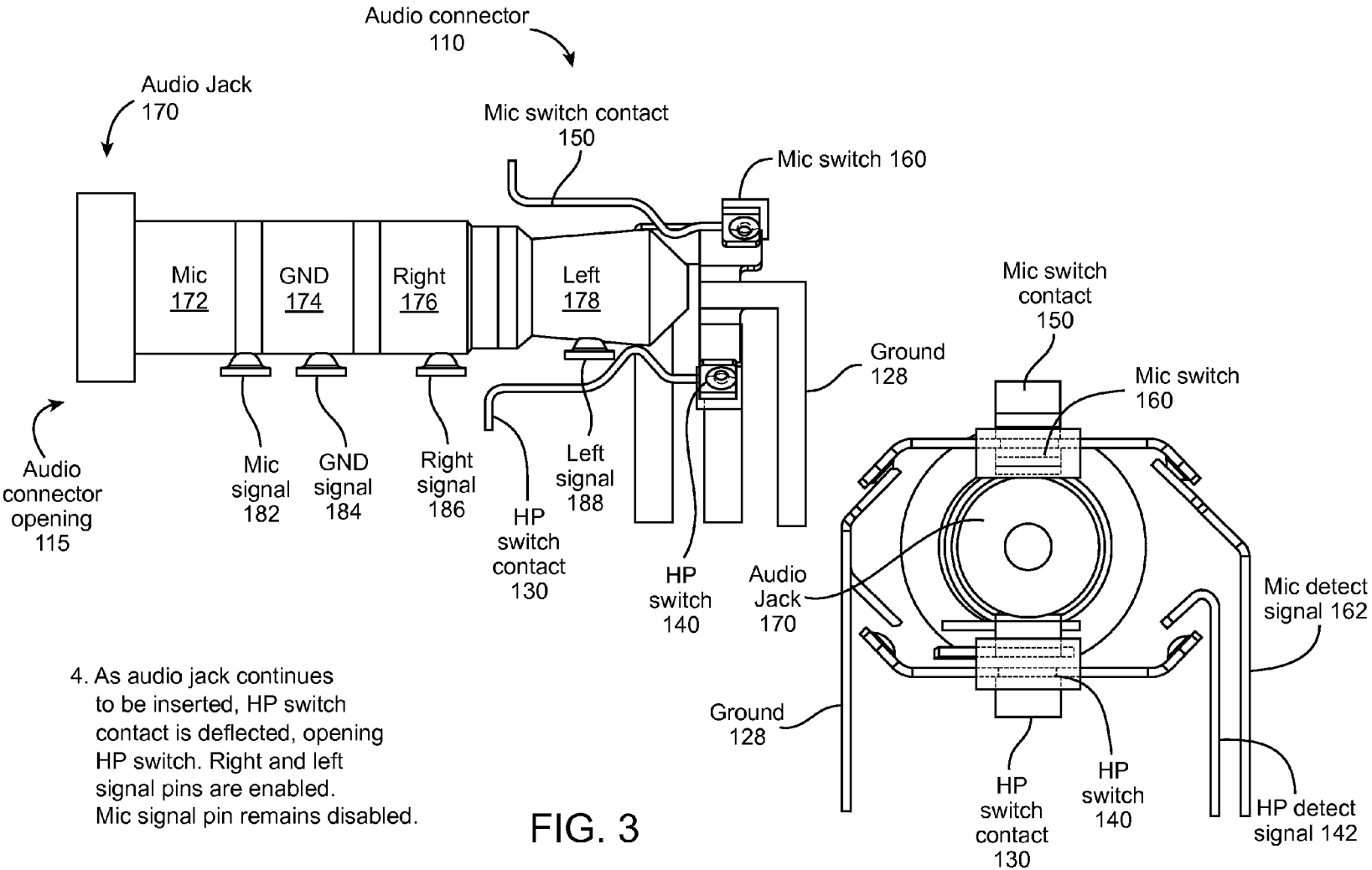
FIG. 3 illustrates the position of an audio jack as it reaches a headphone switch contact in an audio connector according to an embodiment of the present invention.

FIG. 3 illustrates the positions of audio jack 170 and audio connector 110 as audio jack 170 is further inserted into audio connector 110 according to an embodiment of the present invention. In this figure, the leading edge of audio jack 170 has passed beyond the retention clips and has reached headphone switch contact 130 in audio connector 110. At this point, audio jack 170 may push the headphone switch contact 130 downward, opening headphone switch 140. The opening of headphone switch 140 may be used to route audio signals to and from right 186 and left 188 signal pins on audio connector 110 from to contacts 176 and 78 on audio jack 170.

Figure 4:
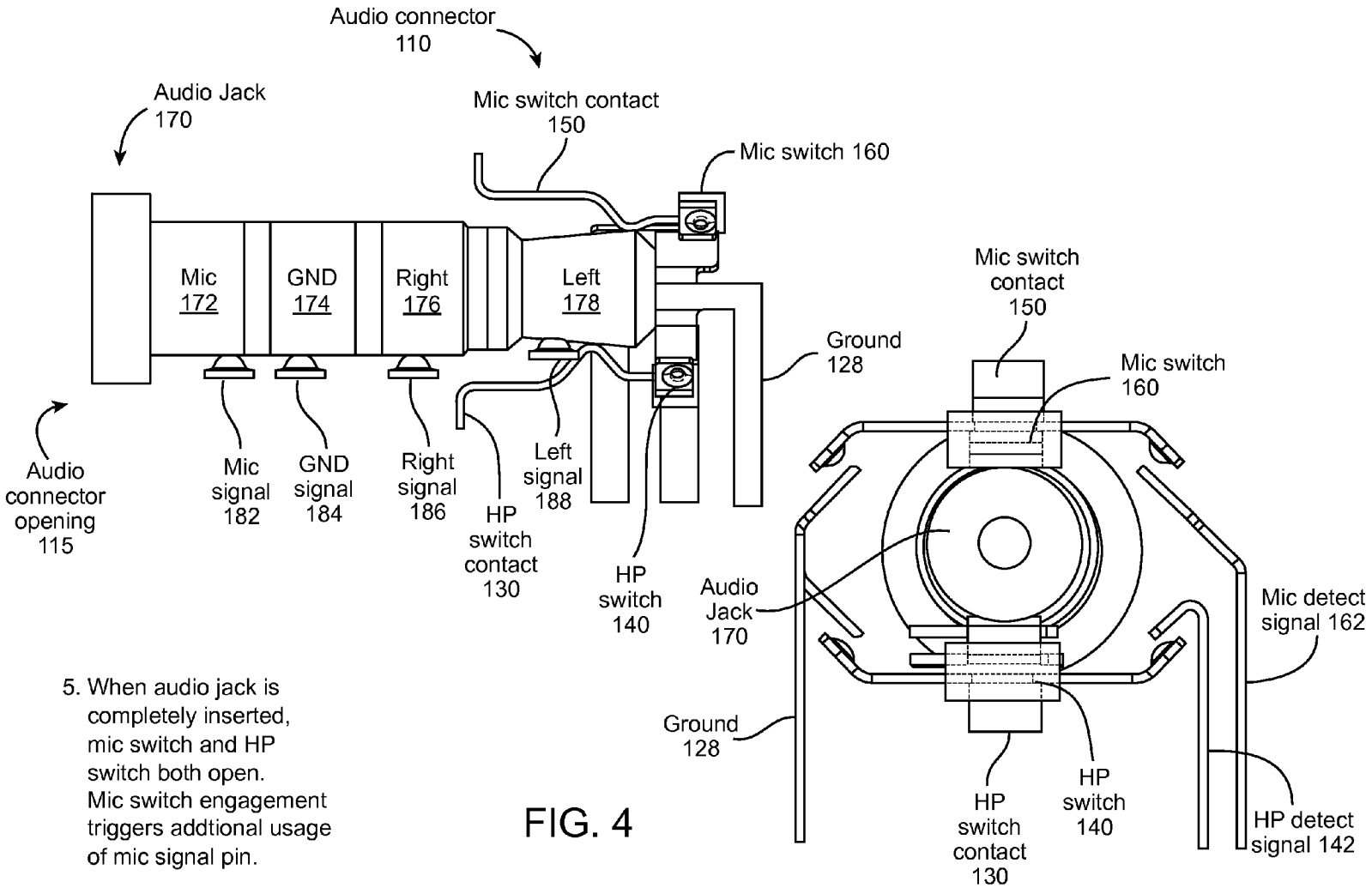
FIG. 4 illustrates the position of an audio jack in an audio connector according to an embodiment of the present invention when a microphone switch contact is reached.

FIG. 4 illustrates the position of audio jack 170 in audio connector 110 when microphone switch contact 150 is reached. At this point, headphone switch contact 130 may remain displaced, such that headphone switch 140 is open. Microphone switch contact 150 may similarly be displaced upward, thereby opening microphone switch 160. Microphone switch 160 may be used to route signals on microphone contact 172 on audio jack 170 to circuitry associated with audio connector 110 via microphone signal pin 182. In this configuration, microphone 182, right 186, and left 188 signal pins may all be enabled.

At this point, audio jack 170 may be at least nearly completely inserted into audio connector 110. Again, in a specific embodiment of the present invention, microphone switch contact 150 may be displaced when audio jack 170 is inserted far enough into audio connector 110 such that microphone contact 172 on audio jack 174 comes into contact with a microphone signal pin 182 in audio connector 110.

Again, it is desirable that audio signals not be routed away from audio jack 170 when audio jack 170 is slightly pulled out of audio connector 110. For this reason, in this example, headphone switch contact 130 may be placed closer to opening 115 in audio connector 110. In that way, when audio jack 170 is slightly pulled out of audio connector 110, headphone switch 140 may remain open. An example of this is shown in the following figure.

Figure 5:
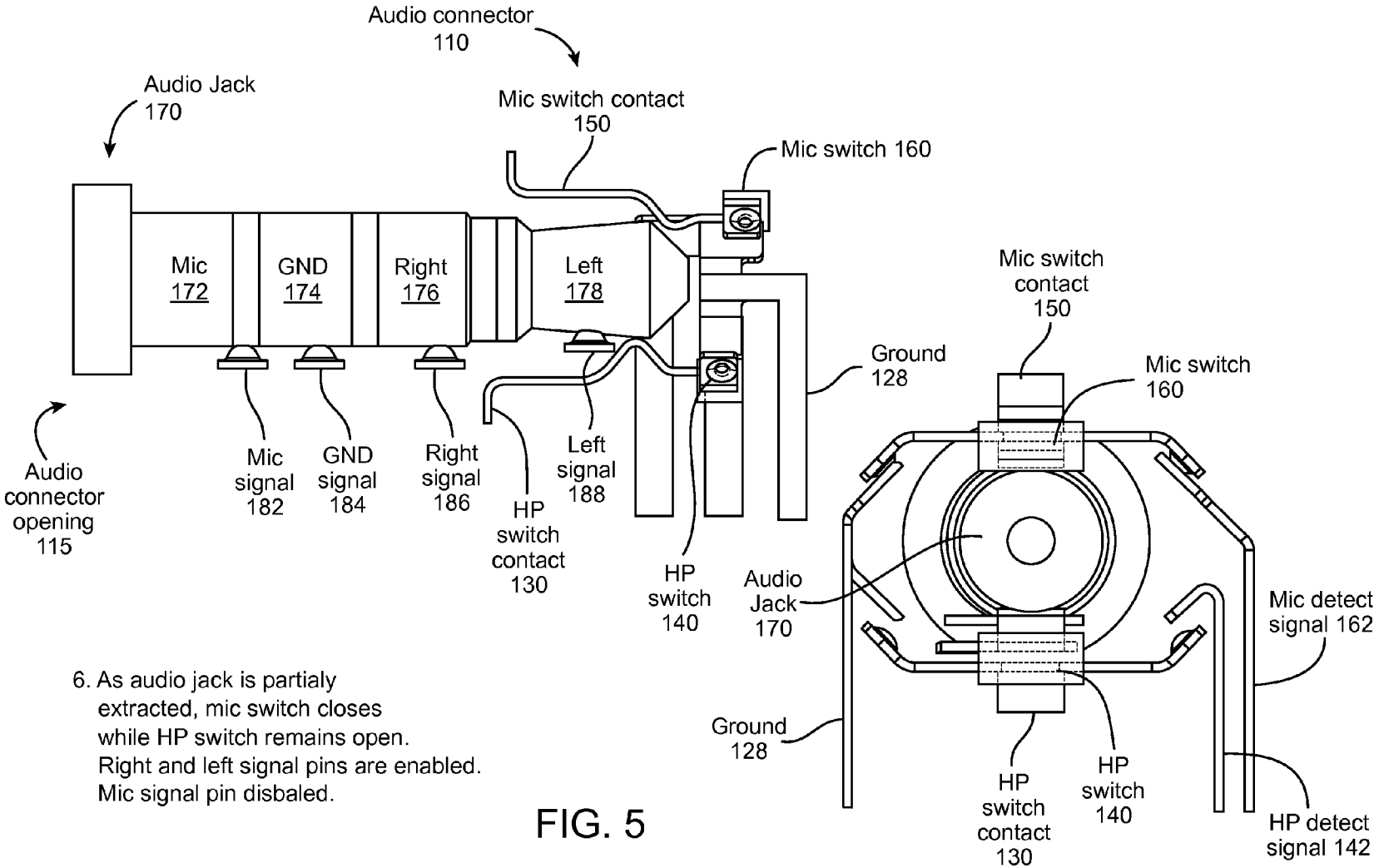
FIG. 5 illustrates the position of an audio jack when it is slightly extracted from an audio connector according to an embodiment of the present invention.

FIG. 5 illustrates the position of audio jack 170 when it is slightly extracted from audio connector 110. In this example, microphone switch contact 150 has been allowed to return to its original position, closing microphone switch 160. Headphone switch contact 130 may remain displaced downward, thereby keeping headphone switch 140 open and preventing the audio signals from being routed away from audio jack 170. In this configuration, right 186 and left 188 signal pins may be enabled, while microphone signal pin 182 may be disabled.

Figure 6:
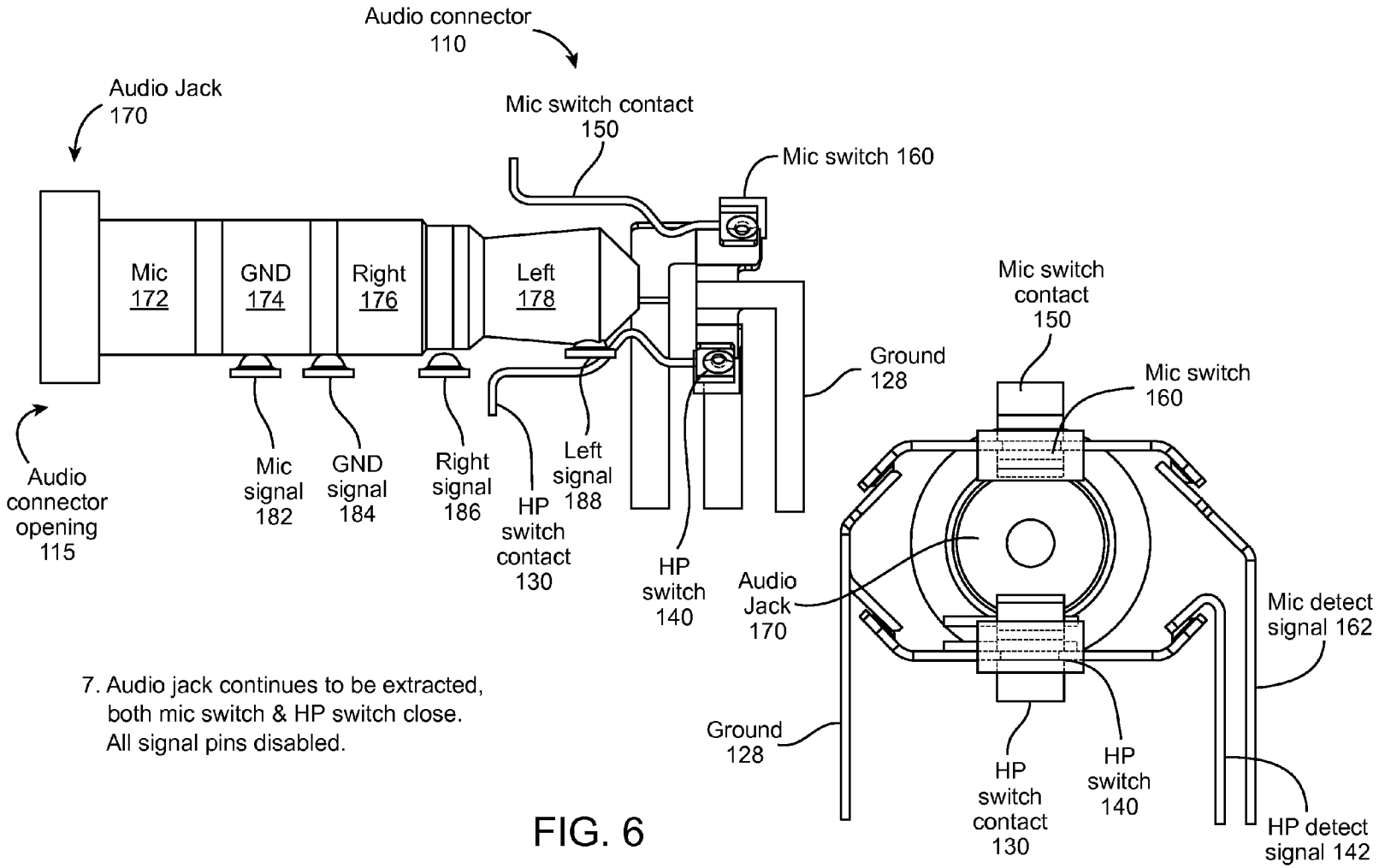
FIG. 6 illustrates the position of an audio jack when it is more fully extracted from an audio connector according to an embodiment of the present invention.

FIG. 6 illustrates the position of audio jack 170 when it is more fully extracted from audio connector 110. In this configuration, the headphone switch 140 and microphone switch 160 may both be closed, and all signal pins, microphone 182, right 186, and left 188 may be disabled.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An audio connector having a front and a back and comprising:

a first detection switch located near the back of the audio connector;

a second detection switch located between the first detection switch and the front of the audio connector; and a microphone contact located between the second detection switch and the front of the audio connector, wherein the microphone contact is positioned in the audio connector to form an electrical connection with a microphone contact on an audio jack when the first detection switch detects the presence of the audio jack.

2. The audio connector of claim 1 wherein the front of the audio connector comprises an opening for receiving the audio jack.

3. The audio connector of claim 1 wherein the first detection switch comprises a first finger and a first contact switch.

4. The audio connector of claim 3 wherein the first finger is displaced when a portion of the audio jack is inserted into the audio connector such that a microphone contact on the audio connector comes into contact with the microphone contact on the audio jack.

5. The audio connector of claim 3 wherein the first finger is displaced when the audio jack is inserted into the audio connector and returns to its original position when the audio jack is removed from the audio connector.

6. The audio connector of claim 3 wherein the second detection switch comprises a second finger and a second contact switch.

7. The audio connector of claim 6 wherein the first detection switch is coupled to first circuitry to receive signals from the microphone contact in the audio connector and the second detection switch is coupled to second circuitry to provide signals to one or more audio contacts in the audio connector.

8. The audio connector of claim 1 further comprising microphone circuitry coupled to the microphone contact, wherein the microphone circuitry is activated when the first detection switch detects the presence of the audio jack.

9. The audio connector of claim 8 further comprising:

a right signal contact; and a left signal contact.

10. The audio connector of claim 9 further comprising headphone circuitry coupled to the right signal contact and the left signal contact, wherein the headphone circuitry is activated when the second detection switch detects the presence of the audio jack.

11. An electronic device comprising:

an audio connector having a front and a back and comprising:

a first detection switch located near the back of the audio connector; and a second detection switch located between the first detection switch and the front of the audio connector;

a microphone circuit coupled to the first detection switch, wherein the microphone circuit is activated when the first detection switch detects the presence of an audio jack in the audio connector; and a headphone circuit coupled to the second detection switch, wherein the headphone circuit is activated when the second detection switch detects the presence of the audio jack in the audio connector.

12. The electronic device of claim 11 wherein the electronic device is a tablet computer.

13. The electronic device of claim 11 wherein the electronic device is a computer.

14. The electronic device of claim 11 wherein the electronic device is a portable media player.

15. The electronic device of claim 11 wherein the audio connector further comprises a microphone contact coupled to the microphone circuit.

16. The electronic device of claim 15 wherein the microphone contact is positioned in the audio connector to form an electrical connection with a microphone contact on the audio jack when the first detection switch detects the presence of the audio jack.

17. The electronic device of claim 16 wherein the audio connector further comprises a right signal contact and a left signal contact coupled to the headphone circuit.

18. An audio connector having a front and a back and comprising:

a first detection switch located near the back of the audio connector;

a second detection switch located between the first detection switch and the front of the audio connector;

a microphone contact located between the second detection switch and the front of the audio connector, a left signal contact located between the second detection switch and the microphone contact;

a right signal contact located between the left signal contact and the microphone contact;

a microphone circuit coupled to the first detection switch and the microphone contact, wherein the microphone circuit is activated when the first detection switch detects the presence of an audio jack in the audio connector; and a headphone circuit coupled to the second detection switch, the left signal contact, and the right signal contact, wherein the headphone circuit is activated when the second detection switch detects the presence of the audio jack in the audio connector, wherein the left signal contact is positioned in the audio connector to form an electrical connection with a left signal contact on the audio jack when the second detection switch detects the presence of the audio jack.

19. The audio connector of claim 18 wherein the right signal contact is positioned in the audio connector to form an electrical connection with a right signal contact on the audio jack when the second detection switch detects the presence of the audio jack.

20. The audio connector of claim 19 wherein the microphone contact is positioned in the audio connector to form an electrical connection with a microphone contact on the audio jack when the first detection switch detects the presence of the audio jack.

* * * * *